United States Patent [19]

Izraeli

[11] 4,103,986

[45] Aug. 1, 1978

[54] ELECTRICAL TERMINAL

[75] Inventor: Hyman Izraeli, West Caldwell, N.J.

[73] Assignee: Thomas & Betts Corporation, Elizabeth, N.J.

[21] Appl. No.: 832,679

[22] Filed: Sep. 12, 1977

[51] Int. Cl.[2] ..... H01R 11/10

[52] U.S. Cl. ..... 339/272 UC

[58] Field of Search ..... 339/272 R, 272 A, 272 UC

[56] References Cited

U.S. PATENT DOCUMENTS

| | | | |
|---|---|---|---|
| 2,074,898 | 3/1937 | Fotsch | 339/272 UC |
| 2,132,967 | 10/1938 | Pennell | 339/272 UC |
| 2,976,515 | 3/1961 | Charbonneau et al. | 339/272 UC |
| 3,683,414 | 8/1972 | DeAngelo et al. | 339/272 UC |

*Primary Examiner*—Joseph H. McGlynn

*Attorney, Agent, or Firm*—David Teschner; Jesse Woldman

[57] ABSTRACT

An electrical terminating device includes a prestessed generally annular split collar member having its free ends held apart by a rigid bridge member having leg portions urged into abutting engagement with the free ends of a lower saddle member to maintain the bowed side walls of the collar member in a preloaded condition. A slidable pressure plate is introduced within the interior of the assembly for cooperation with a pressure screw extending inwardly from the bridge member to pressure connect a conductor end to the saddle member upon suitable rotation of the pressure screw, the preloaded bowed side walls of the collar member operating to compensate for any expansion and contraction of the conductor while connected within the device.

17 Claims, 13 Drawing Figures

ELECTRICAL TERMINAL

BACKGROUND OF THE INVENTION

1. Field of the Invention

The invention is directed to the field of pressure connectors for electrical conductors and the like.

2. Description of the Prior Art

Various prior art pressure or clamp connectors for coupling an electrical conductor to a further part are exemplified in U.S. Pat. No. 2,132,967 issued to F. Pennell on Oct. 11, 1938; U.S. Pat. No. 2,809,363 issued to G. Schertel et al. on Oct. 8, 1957; U.S. Pat. No. 3,863,414 issued to G. DeAngelo et al. on Aug. 8, 1972; German Pat. No. 1,091,168 (Siemens); and German Pat. No. 1,196,742 (Siemens). Each of these devices, except for the Pennell device, is generally disclosed as providing a resilient spring band housing to maintain pressure on a conductor seated between lower and upper pressure plates. In each case the side walls of the band within which the parts are located are aligned in generally parallel relationship thereby severely limiting the amount of residual resiliency available after the pressure connection has been effected. An attempt to compensate for this shortcoming is disclosed by Schertel and Siemens' 168 whereby the side walls are provided with indented portions for expansion. In each case, however, the encompassing spring band is in a relaxed state prior to the application of force to the connection through the pressure plates so that the reacting force which is available to maintain the conductor in pressure engagement with the pressure plates is limited by the amount of pressure which can be applied by movement of a threaded screw means which is driven against one of the pressure plates. The Schertel and Siemens' 168 devices, although providing a limited amount of extension of the side walls of the spring band, still only provide a limited amount of compression force between the conductor and the pressure plates due to the geometry of these devices since the compressive forces are derived from only a small section of the spring band or enclosure. Accordingly, these prior art devices approach their elastic limit at a relatively low compression force thereby seriously limiting their effectiveness in many cases where high pressure forces are required, such as, for example, where it is necessary to provide a reliable mechanical connection to aluminum cables and the like which have relatively high coefficients of expansion and contraction in comparison with copper, and where the necessity for maintaining high pressure between a terminal and the aluminum surface is necessary to avoid the problems of oxidation and the resulting increase in resistance occasioned thereby.

SUMMARY OF THE INVENTION

The invention overcomes the limitations and difficulties noted above with respect to prior art devices by providing a prestressed and preloaded terminating device which is more efficient and more reliable than such prior art devices. The device includes a split prestressed collar member encircling the various other parts of the connector so as to hold them in abutting relationship while the sides of the collar member are preloaded to provide a tight assembly in which reacting forces are available prior to the application of any pressure to a conductor end seated within the device. The free ends of the collar member which is formed in a partial annular, elliptical, or oval shape are held apart by a rigid bridge member which is provided with down-turned leg portions straddling the collar member and which abut the opposing free ends of a saddle member seated within the closed loop portion of the collar member to maintain the collar member in a preloaded configuration. A floating pressure plate formed preferably with upturned sides which extend beyond the periphery of the leg portions of the bridge member to entrap the pressure plate therebetween is activated by a pressure screw extending through the bridge member so that, upon application of torque to the pressure screw the pressure plate is forced downwardly towards the saddle member thereby exerting the required pressure against a conductor end placed between the pressure plate and the saddle member. As the torque on the pressure screw is increased the bowed side walls of the collar member provide a counteracting force which is transmitted to the saddle member in a direction substantially normal to the restraining force of the side walls thereby providing a counteracting force on the saddle member which is many times greater than the force to which the side walls are subjected. Accordingly, extremely high pressures may be applied between the pressure plate and the saddle member within the elastic range of the side walls on the collar member thereby insuring adequate compensation for expansion and contraction of the conductor member whether due to creep or temperature cycle variations. It is an object of this invention to provide an improved electrical terminating device.

It is another object of this invention to provide an improved terminating device for aluminum conductors and the like.

It is yet another object of this invention to provide a pressure connector arranged to compensate for extreme variations in contraction and expansion of a conductor seated therewithin.

It is a further object of this invention to provide a preloaded pressure connector.

It is still another object of this invention to provide a means for preloading a pressure connector.

It is yet a further object of this invention to provide a reliable pressure connection between dissimilar metals such as copper and aluminum.

It is still another object of this invention to provide a pressure connector arranged to permit extremely high compressive forces to be applied to a conductor with minimal distortion of the connector elements.

It is yet another object of this invention to provide a pressure connector having improved anti-magnetic properties.

It is yet another object of this invention to provide a pressure connector which is preloaded in two mutually perpendicular directions for increasing the reliability of the pressure connection.

Other objects and features of the invention will be pointed out in the following description and claims and illustrated in the accompanying drawings, which disclose, by way of example, the principle of the invention, and the best mode contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 10:
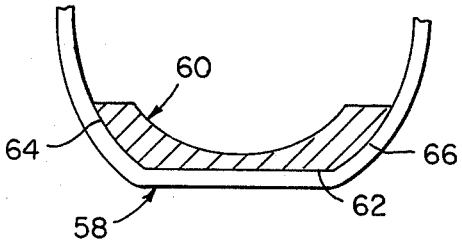
FIG. 10 is a fragmentary side elevational view, partly in section, of a further embodiment of a portion of the device of FIG. 1.
Figure 11:
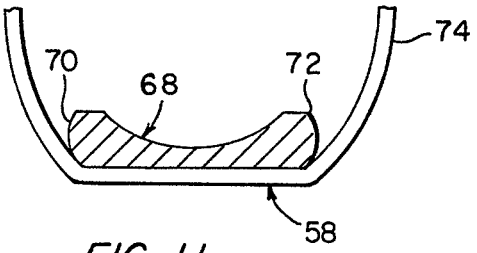
FIG. 11 is a fragmentary side elevational view, partly in section, of yet another embodiment of a portion of the device of FIG. 1.

Referring now to FIGS. 1 through 9 there is shown a terminating device 20 constructed in accordance with the concepts of the invention. The device 20 comprises a collar member 22 which is formed from a length of resilient material such as hardened spring steel preformed into a generally annular, elliptical, or oval shape to provide a prestressed part. The opposing ends of the collar member 22 which are designated by the numerals 24 and 26 are initially disposed in relatively close relationship prior to assembly, as will be described hereafter, and are maintained in a space apart relationship, substantially as shown, by a generally U-shaped bridge member 28 which is provided with protruding ears 30 and 32 which extend within transverse slots 34 and 36 located adjacent the respective free ends 24 and 26 of the collar member 22, permitting the collar member 22 to pivot about each ear 30 and 32 as its side walls are subjected to flexural forces. The bridge member 28 is shown as including a generally planar top portion 38 of substantially rectangular configuration forming the base of the U and leg portions 40, 42, 44, and 46 (FIG. 4) extending downwardly from the top portion 38 at either end thereof. Each of the leg portions is provided preferably with a notched portion 48 the purpose of which is described in more detail hereafter. Seated within the looped portion 50 of the collar member 22 is an arcuately shaped saddle member 52 having longitudinally extending free ends 54 and 56. The saddle member 52 is formed preferably to have an outer surface, that is, the surface adjacent the inner surface of the collar member 22, which has a radius of curvature generally equal to the radius of curvature of the adjacent portion of the inner surface of the collar member 22. However, where necessary or desirable, this configuration may be modified somewhat, as shown in FIGS. 10 and 11 wherein the collar member may be provided with a relatively flat section, as at 58. In such case there may be provided a saddle member 60 having an outer surface 62 (FIG. 10) arranged to conform generally to the shape of the inner surface of the collar member adjacent thereto, and which includes sloped sides 64 and 66 conforming generally to the radius of curvature of the portion of the collar member against which the sides 64 and 66 are seated. In the embodiment shown in FIG. 11 a saddle member 68 is provided with inwardly curved sides 70 and 72 which retreat from the adjacent surface of the collar member 74 permitting a greater degree of deflection or flexure of the side walls of the collar member 74 than is available in the embodiment shown in FIG. 10.

Returning now to FIGS. 1 through 9, the bridge member 22 is located in such manner with respect to the saddle member 52 as to cause the notched portions 48 of the bridge member 22 to abut the free ends 54 and 56 of the saddle member 52 which advantageously serves to hold the saddle member in place in the required position within the collar member 22. The manner in which the saddle member 52 is installed in the collar member 22, which will be described in detail hereafter, insures that a tight abutting fit is maintained between the bridge member 28 and the saddle member 52 as a result of the elastic properties of the collar member 22. Intermediate the bridge member 28 and the saddle member 52 is a free floating pressure plate 76 which is shown as having a bowed central portion 78 (FIG. 3) terminating in upturned end portions 80 and 82, each of which includes a pair of spaced opposing projections 84 which extend beyond the inner edges of the leg portions of the bridge member 28 and embrace the outer surface thereof. This arrangement serves to entrap the pressure plate 76 within the collar member 22 while additionally providing guide means for the pressure plate 76 in its movement along a path towards and away from the saddle member 52. Centrally located within the upper surface 86 of the central portion 78 of the pressure plate 76 is an annular depression or recess 88 adapted to receive the rounded lower end 90 (FIG. 3) of a pressure screw 92 which is threadably engaged in a threaded opening 94 in the bridge member 28. The recess 88 serves to provide a convenient locating means for the end 90 of the pressure screw 92 while decreasing the friction between the end 90 of the screw 92 and the adjacent surface of the pressure plate 76. Aligned with the recess 88 on the opposite surface 96 of the pressure plate 76 is a raised portion 98 which serves to concentrate the compressive forces exerted by the pressure plate 76. It should be appreciated that the disposition of the pressure plate 76 as a free floating element separate from the screw 92 permits it to be raised and lowered at will without the necessity of rotating the screw 92 to preposition the pressure plate 76 which preparing to receive a conductor such as shown by the dotted outline 100 in FIG. 3 within the variable conductor receiving opening 102 located between the pressure plate 76 and the saddle member 52. In the particular embodiment described herein, the saddle member 52 is shown as being coupled to a tongue portion 104 which may be provided with a transverse opening 106 or other convenient means for attaching the terminating device 20 to a further member.

Figure 1:
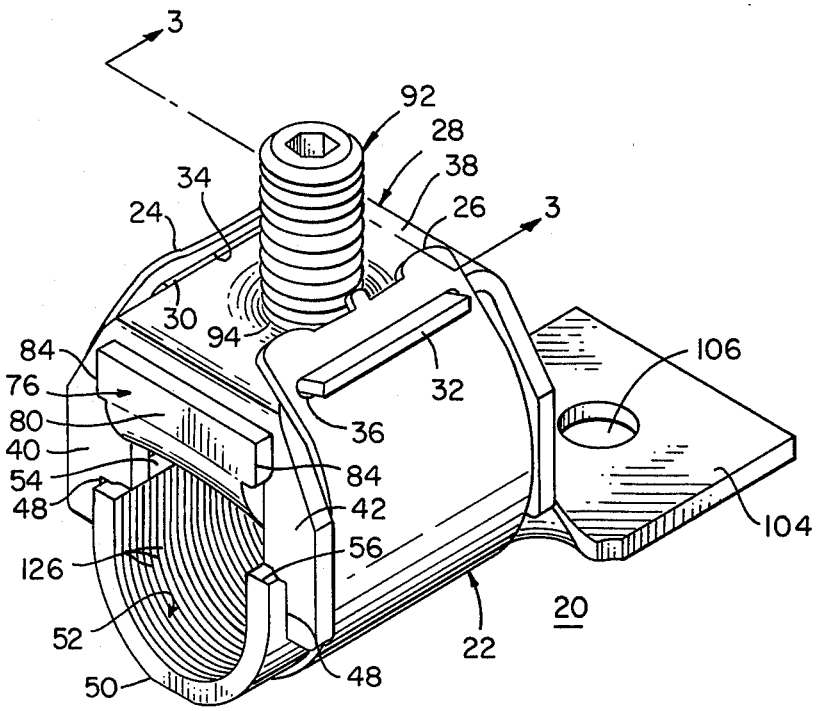
FIG. 1 is a perspective view of a terminating device constructed in accordance with the concepts of the invention.
Figure 2:
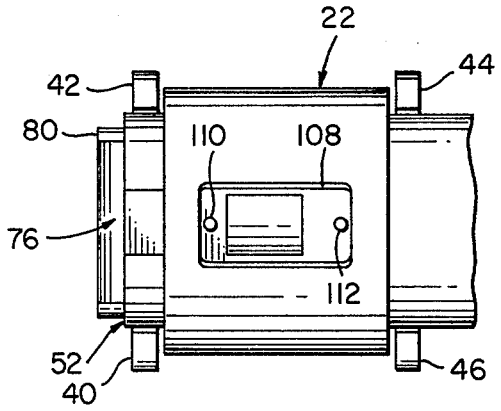
FIG. 2 is a fragmentary bottom view of the device of FIG. 1.
Figure 3:
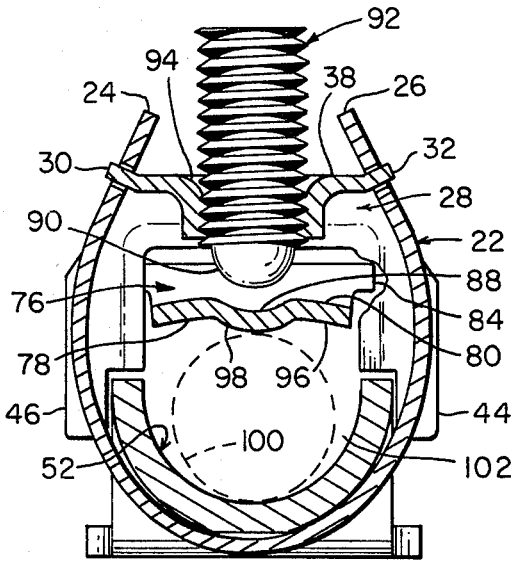
FIG. 3 is a side elevational view taken along the line 3—3 of FIG. 1.
Figure 4:
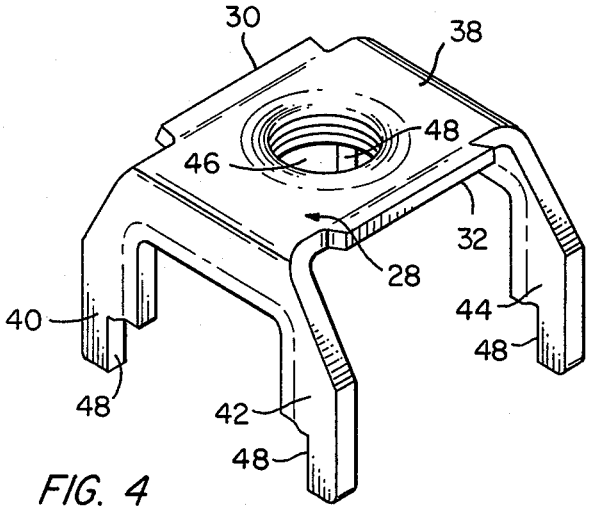
FIG. 4 is a perspective view of the bridge member of the device of FIG. 1.
Figure 5:
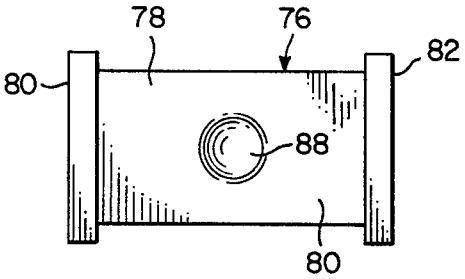
FIG. 5 is a top plan view of the pressure plate of the device of FIG. 1.

Referring now specifically to FIG. 2, the collar member 22 may be provided with means such as a transverse opening 108 which is appropriately dimensioned to significantly reduce the cross sectional area of the collar member 22 in the general area of the opening 108, thus advantageously increasing the magnetic resistance of the collar member 22. This feature has been found to be particularly advantageous where the device 20 is employed to connect parts carrying relatively high currents. In such cases, the increase in the magentic reluctance of the collar member 22 serves to substantially reduce the heating which may be generated by eddy current and hysteresis losses. As further shown in FIG. 2, the saddle member 52 may be provided with means such as spaced protrusions 110 and 112 which serve to direct the location of the saddle member relative to the collar member 22 as the saddle member 52 is assembled thereto. Although the collar member 22 is shown as having a single transverse opening 108, more than one such opening may be provided at selective locations about the periphery thereof, where necessary or desirable.

Figure 7:
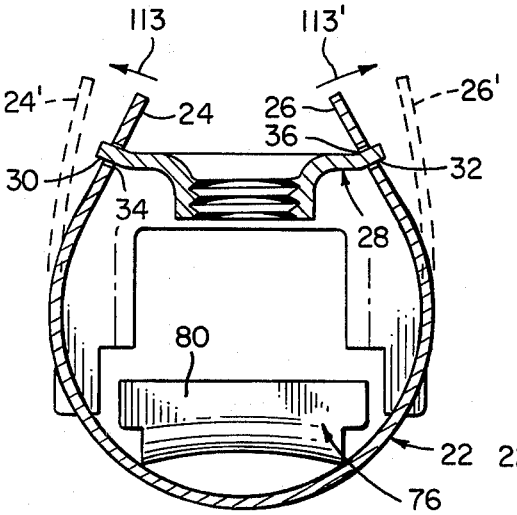
FIG. 7 is a side elevational view, partly in section, showing a step in the assembly of the device of FIG. 1.
Figure 6:
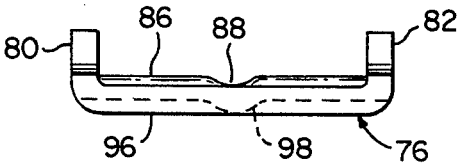
FIG. 6 is a side elevational view of the pressure plate shown in FIG. 5.
Figure 8:
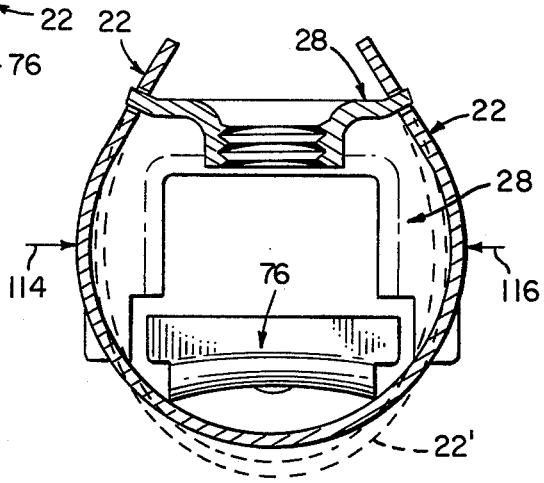
FIG. 8 is a side elevational view, partly in section, showing a further step in the assembly of the device of FIG. 1.
Figure 9:
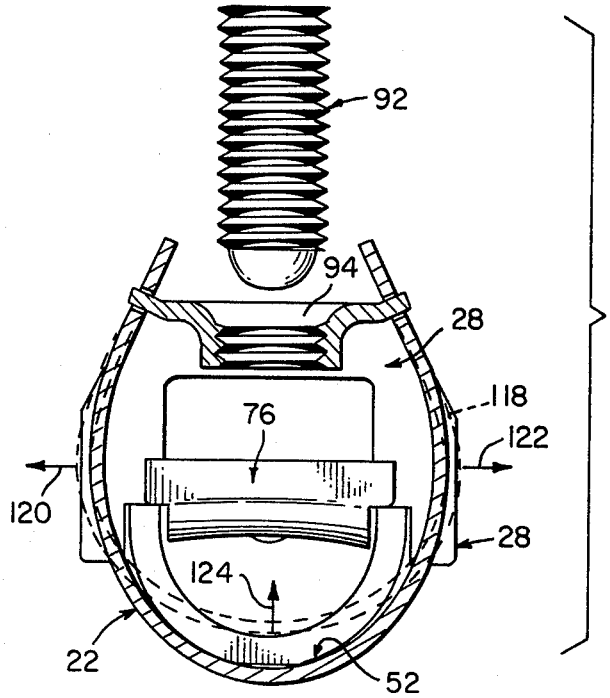
FIG. 9 is a side elevational view, partly in section, showing the direction of forces applied to the device of FIG. 1.

Turning now to FIGS. 7, 8, and 9, a preferable mode of assembly of the device 20 is shown to more clearly illustrate its operation. The collar member 22 is initially formed preferably in an annular, elliptical, or similar shape with a relatively narrow gap between its free ends 24 and 26. The bridge member 28 may then be inserted in position between the ends 24 and 26 by applying suitable forces in the directions indicated by the arrows 113 and 113' to spread the free ends 24 and 26 as shown by the dotted outlines designated 24' and 26' in FIG. 7 and then placing the bridge member 28 therebetween, allowing the projections 30 and 32 to be aligned with the slots 34 and 36 in the collar member 22, and releasing the ends 24 and 26, causing the projections 30 and 32 to enter the slots 34 and 36. The bridge member 28 thus operates to hold the ends 24 and 26 in spaced apart relationship against the restoring forces in the collar member 22 which is thereby preloaded in its static state. Alternatively the bridge member 28 may be placed within the collar member 22 through the slotted opening between the ends 24 and 26 and then forced upwardly, as viewed in FIG. 7. The bridge member projections 30 and 32 are then caused to bear against the interior of the collar member 22, forcing the free ends 24 and 26 apart sufficiently to permit the projections to engage and enter the collar member slots 34 and 36. With the bridge member 28 in place, the pressure plate 76 is placed in the looped portion of the collar member 22, substantially as shown in FIG. 7, so that its upturned end portions 80 and 82 extend beyond the outer extremities of the leg portions of the bridge member 28.

Referring now specifically to FIG. 8, the side walls of the collar member 22 are urged towards one another by the application of forces substantially in the directions indicated by the arrows 114 and 116, causing the collar member 22 to assume an oval configuration substantially as shown by the dotted outline 22'. The saddle member 52 may now be placed in the extended lower looped portion of the collar member 22, as viewed in FIG. 9 and the forces 114 and 116 removed. The dotted outline designated by the numeral 118 (FIG. 9) illustrates the configuration of the collar member 22 prior to the insertion of the saddle member 52 therewithin, while the solid outline indicates the final configuration of the collar member 22 with the saddle member 52 in place. As the side walls of the collar member 22 tend to return to their original configuration which is exemplified by the solid outline in FIG. 8 and the dotted outline 118 in FIG. 9, there are generated a pair of opposing forces indicated by the arrows 120, 122 (FIG. 9) which, in turn, generate a further force in a direction normal to the force vectors 120 and 122, and indicated by the arrow 124. The force indicated by the arrow 124 tends to drive the saddle member 52 upwardly, as viewed in FIG. 9, into abutting relationship with the respective leg portions of the bridge member 28. Thus, the bridge member 28 and the saddle member 52 are held in assembled relationship by the remaining elastic forces in the collar member 22. The saddle member 52 is made large enough so as to prevent the collar member 22 from fully returning to its initial position thereby insuring that the saddle member 52 will be maintained in abutting relationship with the bridge member 28 after the forces indicated by the arrows 114 and 116 in FIG. 8 are removed. This same residual force in the collar member 22 services to further preload it in its static state. It should be noted that, during the assembly of the saddle member 52 within the collar member 22, the pressure plate 76 is brought into engagement with the bridge member 28 so as to provide sufficient clearance for the introduction of the saddle member 52 in its proper position within the collar member 22. The pressure screw 92 is now introduced into the threaded opening 94 in the bridge member 28 to complete the assembly of the device 20.

The saddle member 52 may be provided with ridges 126 on its inner surface (FIG. 1) for biting engagement with the outer surface of a conductor urged into contact therewith.

Figure 12:
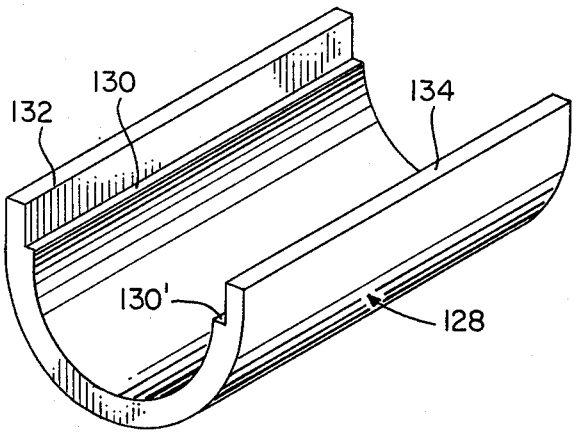
FIG. 12 is a perspective view of a further embodiment of a saddle portion of a terminating device constructed in accordance with the concepts of the invention.
Figure 13:
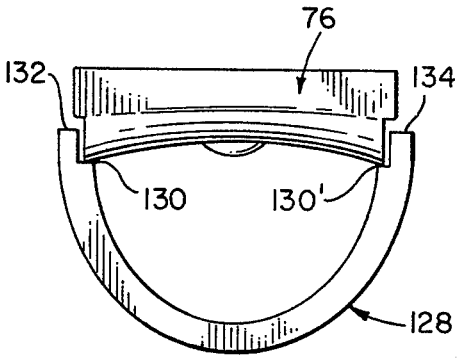
FIG. 13 is a side elevational view of the embodiment shown in FIG. 12, including a pressure plate engaged therewith.

Referring now to FIGS. 12 and 13, there is shown a further embodiment of a saddle member 128 constructed in accordance with the concepts of the invention. The saddle member 128 is substantially similar to member 52 but further includes stop means shown as a longitudinally extending shoulder portion 130, 130' adjacent each respective free end 132, 134 which, as illustrated in FIG. 13, serve to provide a limit stop for the pressure plate 76 in its downward travel, as viewed in FIG. 13. It will, of course, be readily apparent to those skilled in the art that other stop means arrangements such as suitably positioned raised protrusions (not shown) may be employed in a similar manner without departing from the spirit of the invention and within the concepts herein disclosed. It should be further noted that the collar member 22, although shown as having a smoothly curving surface, may be formed in a variety of polygonal shapes (not shown) having a similar generally annular, elliptical, or oval configuration, within the concepts herein disclosed.

The embodiments of the invention in which an exclusive property or privilege is claimed are defined as follows:

1. A terminating device comprising: a resilient generally annular prestressed split collar member having free ends each of which has an elongate transverse slot therethrough; a generally U-shaped bridge member seated tightly between said free ends to maintain said free ends in spaced apart relationship and to preload said collar member, said bridge member having a top portion and opposing leg portions, said leg portions extending from lateral edges of said top portion and straddling the sides of said collar member, said top portion having a generally centrally located threaded opening therethrough; a pressure screw threaded within said threaded opening in said bridge member and extending within the interior of said collar member; an arcuate saddle member seated against an inner surface of said collar member opposite said bridge member and having an outer surface having a radius of curvature generally equal to the radius of curvature of the adjacent portion of said inner surface of said collar member and seated intimately thereagainst, said saddle member having free ends each of which abuts a respective pair of free ends of said leg portions of said bridge member, said bridge member and said saddle member being held in abutting relationship by the stored energy in said preloaded collar member; and a pressure plate slidably disposed between said bridge member and said saddle member, said pressure plate being engageable by said pressure screw for movement towards said saddle member to provide a variable conductor receiving opening therebetween, the bowed sides of said collar member providing a reacting force against pressure exerted on said saddle member as said pressure plate is brought to bear against the portion of a conductor placed within said conductor receiving opening to compensate for the expansion and contraction of such portion by providing a relatively constant pressure thereagainst.

2. A terminating device as defined in claim 1 wherein said bridge member comprises opposed projections extending from said top portion, each of said projections engaging a respective one of said transverse slots in said collar member.

3. A terminating device as defined in claim 1 wherein said saddle member includes ridges disposed along the interior surface thereof for biting engagement with a conductor pressed into engagement therewith.

4. A terminating device as defined in claim 1 wherein each of said leg portions of said bridge member includes a notched portion for abutting engagement with a respective one of said free ends of said saddle member.

5. A terminating device as defined in claim 1 wherein said saddle member includes an apertured tongue portion for coupling said terminating device to a further member.

6. A terminating device as defined in claim 1 wherein said pressure plate further includes guide means cooperable with said bridge member for selectively directing the path of said pressure plate.

7. A terminating device as defined in claim 6 wherein said pressure plate comprises opposing end portions, said guide means comprising projections on said end portions for sliding engagement with said leg portions of said bridge member.

8. A terminating device as defined in claim 1 wherein said pressure plate comprises a bowed central portion intermediate said end portions and having a concave surface facing said saddle member and a convex surface facing said bridge member.

9. A terminating device as defined in claim 8 wherein said convex surface of said central portion has a depressed area for receiving the free end of said pressure screw.

10. A terminating device as defined in claim 8 wherein said concave surface of said central portion includes a raised portion arranged to concentrate a portion of the compressive force of said pressure plate in a selective area.

11. A terminating device as defined in claim 1 wherein said collar member further comprises means for increasing the magnetic resistance thereof.

12. A terminating device as defined in claim 11 wherein said means comprises a transverse opening in said collar member selectively dimensioned to substantially reduce the cross sectional area of said collar member adjacent said transverse opening.

13. A terminating device as defined in claim 12 wherein said transverse opening is located generally adjacent said saddle member.

14. A terminating device as defined in claim 1 further comprising means on said saddle member cooperable with said collar member for directing the position of said saddle member therewithin.

15. A terminating device as defined in claim 14 wherein said means for directing the position of said saddle member includes spaced protrusions on the outer surface of said saddle member arranged to extend within said transverse opening in said collar member when said saddle member is correctly positioned therewithin.

16. A terminating device as defined in claim 1 wherein said saddle member comprises stop means for restricting the extent of intrusion of said pressure plate therewithin.

17. A terminating device as defined in claim 16 wherein said stop means comprises a longitudinally extending ledge portion adjacent each of said free ends of said saddle member.

* * * * *